US010662575B2

(12) United States Patent
Ahn et al.

(10) Patent No.: US 10,662,575 B2
(45) Date of Patent: May 26, 2020

(54) CLOTHES DRYER AND METHOD FOR CONTROLLING SAME

(71) Applicant: LG ELECTRONICS INC., Seoul (KR)

(72) Inventors: Seungphyo Ahn, Seoul (KR); Seonghwan Kim, Seoul (KR); Bio Park, Seoul (KR); Hyunwoo Noh, Seoul (KR); Hyuksoo Lee, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 219 days.

(21) Appl. No.: 15/735,709

(22) PCT Filed: May 20, 2016

(86) PCT No.: PCT/KR2016/005402
§ 371 (c)(1),
(2) Date: Dec. 12, 2017

(87) PCT Pub. No.: WO2016/204415
PCT Pub. Date: Dec. 22, 2016

(65) Prior Publication Data

US 2018/0142408 A1 May 24, 2018

(30) Foreign Application Priority Data

Jun. 19, 2015 (KR) ..... 10-2015-0087595
Jun. 19, 2015 (KR) ..... 10-2015-0087596

(51) Int. Cl.
*D06F 58/24* (2006.01)
*D06F 58/20* (2006.01)
*D06F 58/28* (2006.01)

(52) U.S. Cl.
CPC ..... *D06F 58/24* (2013.01); *D06F 58/20* (2013.01); *D06F 58/206* (2013.01); *D06F 58/28* (2013.01);
(Continued)

(58) Field of Classification Search
CPC ..... D06F 58/24; D06F 58/206; D06F 58/28; D06F 58/20; D06F 2058/287;
(Continued)

(56) References Cited

U.S. PATENT DOCUMENTS

2011/0277334 A1 11/2011 Lee et al.

FOREIGN PATENT DOCUMENTS

DE 4409607 A1 10/1994
DE 10255575 C1 12/2003
(Continued)

OTHER PUBLICATIONS

European Search Report, issued in EP Application No. 16811828.9, dated Apr. 16, 2019 (11 pages).
(Continued)

*Primary Examiner* — Jessica Yuen
(74) *Attorney, Agent, or Firm* — Finnegan, Henderson, Farabow, Garrett & Dunner, L.L.P.

(57) ABSTRACT

The present invention relates to a clothes dryer, including a drum, a heat pump cycle having a first evaporator, a compressor and a condenser, and a blower for circulating air, wherein the heat pump cycle includes second to nth evaporators disposed in series with the first evaporator within an air duct; an auxiliary heat exchanger to cool refrigerant discharged from the condenser, and first to nth expansion valves to independently control flow rates of refrigerants flowing into the first to nth evaporators, wherein the dryer further includes a controller to control the compressor according to refrigerant discharge pressure of the compressor or refrigerant inlet pressure of the condenser.

5 Claims, 9 Drawing Sheets

(52) U.S. Cl.
CPC ..... *D06F 2058/287* (2013.01); *D06F 2058/2858* (2013.01); *D06F 2058/2864* (2013.01); *D06F 2058/2877* (2013.01)

(58) Field of Classification Search
CPC ..... D06F 2058/2864; D06F 2058/2877; D06F 2058/2858
See application file for complete search history.

(56) References Cited

FOREIGN PATENT DOCUMENTS

| | | | |
|---|---|---|---|
| EP | 2034084 | A1 | 3/2009 |
| EP | 2549008 | A1 | 1/2013 |
| EP | 2034084 | B1 | 2/2013 |
| EP | 2594687 | A1 | 5/2013 |
| JP | 2007-289558 | A | 11/2007 |
| JP | 2008-048810 | A | 3/2008 |
| JP | 2008-142101 | A | 6/2008 |
| KR | 10-0408060 | B1 | 3/2003 |
| KR | 10-2007-0063997 | A | 6/2007 |
| KR | 10-1167735 | B1 | 7/2012 |

OTHER PUBLICATIONS

International Search Report issued in Application No. PCT/KR2016/005402 dated Sep. 8, 2016 (4 pages).

CLOTHES DRYER AND METHOD FOR CONTROLLING SAME

CROSS-REFERENCE TO RELATED APPLICATIONS

This application is a U.S. National Phase entry under 35 U.S.C. 371 from PCT International Application No. PCT/KR2016/005402, filed on May 20, 2016, which claims the benefit of priority to Korean Application No. 10-2015-0087595, filed on Jun. 19, 2015, and to Korean Application No. 10-2015-0087596, filed on Jun. 19, 2015, the contents of all of which are all hereby incorporated by reference herein in their entirety.

TECHNICAL FIELD

The present invention relates to a clothes dryer having a heat pump cycle and a method for controlling the same.

BACKGROUND ART

Generally, a clothes dryer is an apparatus for drying the laundry by blowing hot air generated by a heater into a drum to evaporate moisture contained in the laundry.

Such clothes dryers may be classified into an exhaust type clothes dryer and a condensation type clothes dryer depending on a method of treating humid air discharged from a drum after the laundry is dried by hot air.

The exhaust type clothes dryer uses a heater or the like to heat new air flowing from the outside of the dryer to it into the drum and exhaust air of high temperature and high humidity discharged from the drum to the outside of the dryer.

The condensing clothes dryer cools hot and humid air discharged from the drum down to a dew point temperature or less in a condenser without exhausting it to the outside of the dryer, so as to condense moisture contained in the humid air, and reheat air passing through the condenser by a heater to circulate the reheated air into the drum.

Here, in the exhaust type clothes dryer, since the humidity of the air discharged from the drum decreases as a drying time elapses, a loss of thermal energy of air, which is discharged to the outside without being used, increases.

Also, in the condensation type clothes dryer, a loss of thermal energy of the air discharged from the drum is caused during the process of condensing the humid air, and the air is reheated by using a separate heater and the like for drying, thereby lowering thermal efficiency.

Accordingly, in recent time, a heat pump dryer, which is provided with an evaporator, a compressor, a condenser, and an expansion valve, and heats air supplied into a drum by recollecting energy of air discharged from the drum, so as to enhance energy efficiency, has been developed.

FIG. 1 is a schematic view illustrating a washing and drying machine 10 having the related art heat pump system.

The washing and drying machine 10 with the heat pump system illustrated in FIG. 1 (see the following prior art document D1) includes a refrigerant circuit 11. The refrigerant circuit 11 includes a high pressure section extending from an outlet of a compressor 12 up to an inlet of an expansion valve 13 via a first heat exchanger (condenser; 14), and a low pressure section extending from an outlet of the expansion valve 13 up to an inlet of the compressor 12 via a second heat exchanger (evaporator; 15). The refrigerant circuit 11 also includes an auxiliary heat exchanger 16 and an auxiliary fan 17. The auxiliary heat exchanger 16 is a heat exchanger that cools refrigerant through heat exchange with external cold air (ambient air). The auxiliary fan 17 is a component for supplying the external cold air. The auxiliary fan 17 may be controlled according to parameters related to dry air for drying the laundry and the refrigerant, namely, air temperature at an inlet side of a drum 18, a refrigerant temperature (or refrigerant pressure) at a rear end of the condenser 14 and a front end of the evaporator 15, or may control the temperature and pressure. For example, when an amount of heat in the heat pump system is exceeded, the auxiliary fan 17 is turned on to remove the exceeded amount of heat, and thus the auxiliary heat exchanger 16 cools refrigerant discharged from the condenser 14. In order to prevent the auxiliary heat exchanger 16 from cooling the refrigerant more than necessary, the auxiliary fan 17 is turned off.

Efficiencies of the heat pump system and the drier 10 can be improved as the auxiliary fan 17 is controlled to be turned on/off by preset upper and lower limit values.

However, in the case of the prior art D1, one evaporator is used to remove moisture of hot and humid air discharged from the drum. However, as temperature of air passing through the evaporator gradually decreases toward a rear end of the evaporator, a temperature difference between the refrigerant and the air passing through the evaporator gradually decreases, which causes a reduction of dehumidifying capability of the evaporator and a delay of the drying time.

In the prior art D1, since the auxiliary fan 17 is turned on/off according to the preset upper and lower limit values, it is difficult to determine whether the auxiliary fan 17 is out of order. In particular, since the auxiliary fan 17 is in an almost stopped state in an eco-mode for energy saving, it is difficult for a user to distinguish whether the stopped state of the auxiliary fan 17 is due to the eco-mode or a breakdown (failure).

As a result, when the dryer 10 is continuously operated without knowing that the auxiliary fan 17 is stopped due to a failure, the dehumidifying capability of the evaporator 15 deteriorates and the drying time increases.

FIG. 2 is a schematic view illustrating a clothes dryer 20 (refer to the prior art document D2) having the related art auxiliary heat exchanger, and FIG. 3 is a perspective view illustrating a heat pump system mounted in the clothes dryer 20 of FIG. 2.

The clothes dryer 20 illustrated in FIG. 2 includes a drum 26, and a heat pump cycle for heating air by inducing refrigerant to a condenser 21, an expansion valve 22, an evaporator 23, and a compressor 24.

The heat pump cycle includes an auxiliary heat exchanger 25 to remove heat from the heat pump cycle. A blower 27 cools an auxiliary heat exchanger 25 and the compressor 24 by ambient air.

The ambient air passes through the auxiliary heat exchanger 25 via a first blower **28*a*, and then is externally discharged through a second blower 28*b* via a periphery of the compressor 24**.

The blowers 27, **28*a*, and 28*b* are controlled in several steps or continuously. For example, the blowers 27, 28*a*, and 28*b* are controlled by varying revolutions per minute (RPMs) thereof. Further, the blowers 27, 28*a*, and 28*b* are controlled according to a change amount of a value T1, T2 or $\Delta T = T1 - T2$ in comparison with a target temperature $T_0$. That is, parameters for controlling the blowers 27, 28*a*, and 28*b* are T1, T2**, and $\Delta T = T1 - T2$, and the target temperature is $T_0$.

However, according to the prior art D2, the first and second blowers **28*a* and 28*b* for blowing ambient air to the auxiliary heat exchanger 25 and the like are implemented as a box fan. Accordingly, the first and second blowers 28***a* and 28*b* are operated by a separate small motor disposed within the box fan, and power for driving the first blower 28*a* and the second blower 28*b* is further required, which results in increasing energy consumption.

For the related art structure of the blowers 27, 28*a*, and 28*b*, their motors are controlled to be turned on/off according to a temperature signal sensed by a temperature sensor or the like, and an on/off signal is unilaterally transmitted to the motors. Accordingly, it is difficult to determine whether the blowers 27, 28*a*, and 28*b* are out of order, and accordingly it is difficult to cope with changes in product performance (performance of the heat pump cycle).

PRIOR ART DOCUMENTS

Patent Documents (Patent Document 1) D1: EP 2594687A1 (May 22, 2013. Open)

(Patent Document 2) D2: EP 2034084131 (Feb. 27, 2013. Open)

DISCLOSURE OF THE INVENTION

Accordingly, a first aspect of the present invention is to provide a clothes dryer, capable of improving dehumidifying capability of an evaporator and reducing a drying time by employing a plurality of evaporators disposed in series.

A second aspect of the present invention is to provide a method of controlling a clothes dryer, capable of adjusting a refrigerant discharge amount by controlling an operation speed of a compressor according to discharge pressure of the compressor.

A third aspect of the present invention is to provide a clothes dryer, capable of facilitating a determination as to whether a blower for cooling an auxiliary heat exchanger is broken down.

A fourth aspect of the present invention is to provide a clothes dryer, capable of saving energy by a simplified structure of an auxiliary cooling fan for blowing air to an auxiliary heat exchanger and no need of an additional driving element for operating the auxiliary cooling fan.

The first aspect of the present invention can be achieved by arranging a plurality of evaporators in series in an air duct.

The second aspect of the present invention can be achieved by controlling a compressor according to refrigerant discharge pressure of the compressor or refrigerant inlet pressure of a condenser.

To achieve the first and second aspects of the present invention, a clothes dryer may include a drum providing an accommodating space for accommodating clothes, a heat pump cycle having a first evaporator, a compressor and a condenser, to apply heat to air circulating back into the drum via the drum, the first evaporator and the condenser, and a blower to circulate the air.

The heat pump cycle may include second to nth evaporators disposed in series with the first evaporator within an air duct forming a circulation flow path of the air, an auxiliary heat exchanger connected to the condenser by a refrigerant pipe to cool a refrigerant discharged from the condenser, and first to nth expansion valves to independently control flow rates of refrigerants flowing into the first to nth evaporators.

The dryer may include a controller configured to control the compressor according to refrigerant discharge pressure of the compressor or refrigerant inlet pressure of the condenser.

According to one embodiment related to the first aspect of the present invention, the compressor may be an inverter type compressor, and the controller may control the flow rate of the refrigerant by varying a frequency of the compressor.

According to one embodiment related to the first aspect of the present invention, an operating speed of the compressor may be controlled according to a refrigerant discharge temperature of the compressor or a refrigerant inlet temperature of the condenser.

To achieve the second aspect of the present invention, a method for controlling a clothes dryer may include, for supplying hot air into a drum using a heat pump cycle provided with first to nth evaporators, a compressor, a condenser, an auxiliary heat exchanger, and first to nth expansion valves, may include turning on the compressor to operate the heat pump cycle, and controlling an operating speed of the compressor according to refrigerant discharge pressure of the compressor or refrigerant inlet pressure of the condenser.

According to one embodiment related to the second aspect of the present invention, the method may include measuring a refrigerant discharge temperature of the compressor or a refrigerant inlet temperature of the condenser before adjusting the operating speed of the compressor after the compressor is operated, cooling refrigerant discharged from the condenser by operating an auxiliary cooling fan when the refrigerant discharge temperature of the compressor or the refrigerant inlet temperature of the condenser exceeds a preset temperature, and adjusting open degrees of the first to nth expansion valves according to temperature or humidity of the air discharged from the drum to adjust the flow rates of the refrigerants flowing into the first to nth evaporators, respectively.

According to one embodiment related to the second aspect of the present invention, the flow rate of the refrigerant flowing into the nth evaporator may be adjusted to be smaller than the flow rate of the refrigerant flowing into the first evaporator, so as to increase a temperature difference between the refrigerant and the air passing through the nth evaporator.

According to one embodiment related to the second aspect of the present invention, the operating speed of the compressor may be lowered when the refrigerant discharge pressure of the compressor or the refrigerant inlet pressure of the condenser is higher than preset maximum pressure, and the operating speed of the compressor may be increased when the refrigerant discharge pressure of the compressor or the refrigerant inlet pressure of the condenser is equal to or lower than preset minimum pressure.

According to one embodiment related to the second aspect of the present invention, the method may include comparing the operating speed of the compressor with the preset maximum speed before increasing the operating speed of the compressor when the refrigerant discharge pressure of the compressor or the refrigerant inlet pressure of the condenser is equal to or lower than the minimum pressure, and increasing the operating speed of the compressor when the operating speed of the compressor is lower than the preset maximum speed whereas maintaining the operating speed of the compressor when the operating speed of the compressor is the maximum speed.

The third aspect of the present invention may be achieved by cooperation with the auxiliary cooling fan and the drum.

The fourth aspect of the present invention may be achieved by using a driving motor for the drum as a power source of the auxiliary cooling fan.

A clothes dryer according to one embodiment related to the third and fourth aspects of the present invention may include a cabinet, a driving motor installed inside the cabinet, a drum rotated by receiving power from the driving motor, an air duct connected to the drum to form a flow path for air circulation, a blower (main fan) installed in the air duct to circulate the air, a heat pump cycle including an evaporator and a condenser installed in the air duct and connected by a refrigerant pipe, to absorb heat of air flowing along the air duct and discharge the heat into air introduced into the drum, an auxiliary heat exchanger installed in the refrigerant pipe to further cool refrigerant passing through the condenser, and an auxiliary cooling fan driven by receiving power from the driving motor to cool the auxiliary heat exchanger.

According to one embodiment related to the third and fourth aspects of the present invention, the auxiliary cooling fan may be connected to an output shaft of the driving motor to be directly driven.

According to one embodiment related to the third and fourth aspects of the present invention, the auxiliary cooling fan may be connected to the drum to be indirectly driven.

According to one embodiment related to the third and fourth aspects of the present invention, the auxiliary cooling fan may be disposed between the driving motor and the auxiliary heat exchanger.

According to one embodiment related to the third and fourth objects of the present invention, the auxiliary cooling fan may be disposed behind the auxiliary heat exchanger to suck external air into the auxiliary heat exchanger.

According to one embodiment related to the third and fourth aspects of the present invention, the dryer may further include slits formed through a front plate of the cabinet, and the external air may be introduced through the slits.

According to one embodiment related to the third and fourth aspects of the present invention, the auxiliary cooling fan may be connected to the drum by a fan belt.

According to one embodiment related to the third and fourth aspects of the present invention, the blower may be driven by mounting a fan motor, separate from the driving motor.

According to one embodiment related to the third and fourth aspects of the present invention, the auxiliary cooling fan may include a rotating shaft, and a rotatable blade cooperatively mounted on the rotating shaft.

Advantageous Effect

According to the present invention having the aforementioned configuration, the following effects can be obtained.

First, a plurality of evaporators can be used to greatly improve dehumidifying capability and shorten a drying time.

Second, the dehumidifying capability of the evaporators can be improved and the drying time can be shortened by controlling an operating speed of the compressor according to refrigerant discharge pressure of the compressor or refrigerant inlet pressure of the condenser.

Third, since a compressor and an auxiliary heat exchanger are controlled by using power of a driving motor for driving a drum, an additional power source which is installed in an existing box fan is not required, which may result in effectively saving energy.

Fourth, a separate small motor can be eliminated from the existing box fan, structural simplification can be achieved.

Fifth, an auxiliary cooling fan can be operable with a drum, which may result in facilitating determination as to whether a clothes dryer is out of order.

MODES FOR CARRYING OUT THE PREFERRED EMBODIMENTS

Hereinafter, a clothes dryer and a method of controlling the same according to the present invention will be described in detail with reference to the drawings. In this specification, the same or equivalent components may be provided with the same or similar reference numbers even in different embodiments, and description thereof will not be repeated. A singular representation may include a plural representation unless it represents a definitely different meaning from the context.

A clothes dryer according to one aspect of the present invention is a dryer capable of improving dehumidifying capability.

Figure 1:
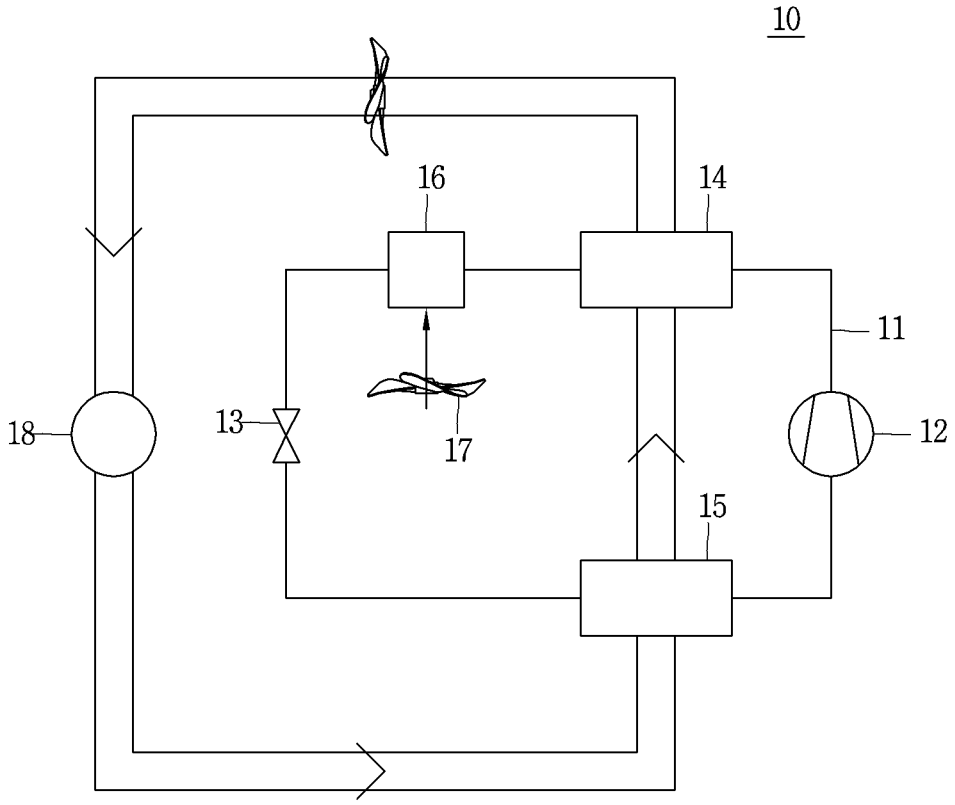
FIG. 1 is a schematic view illustrating a washing and drying machine equipped with a heat pump system according to the related art.
Figure 2:
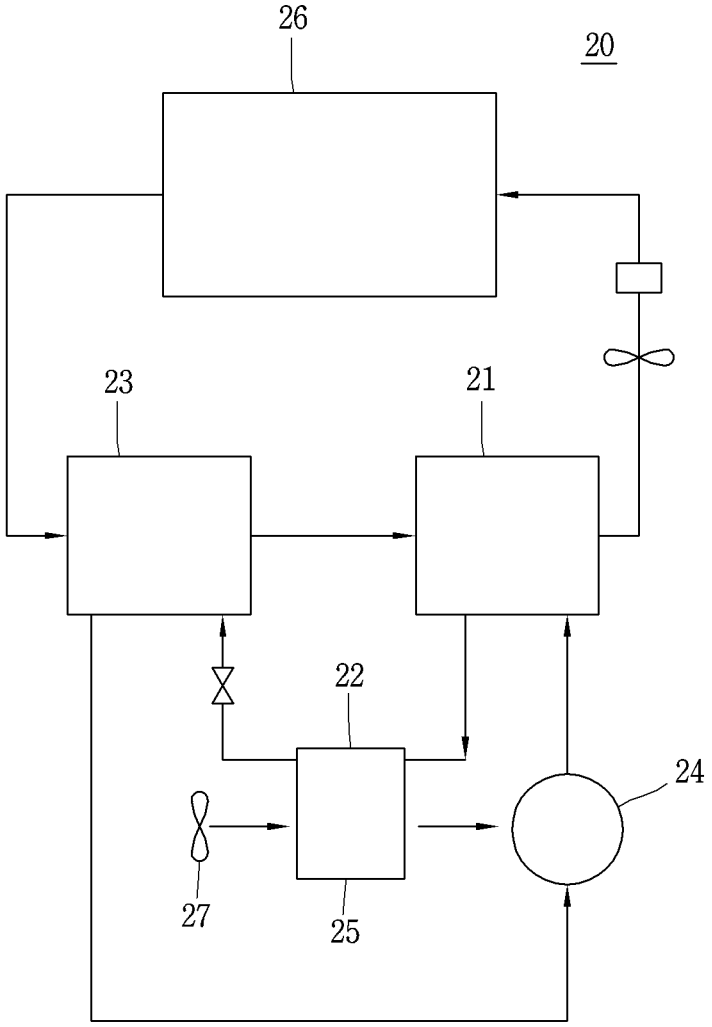
FIG. 2 is a schematic view illustrating a clothes dryer (refer to the prior art document D2) having an auxiliary heat exchanger according to the related art.
Figure 3:
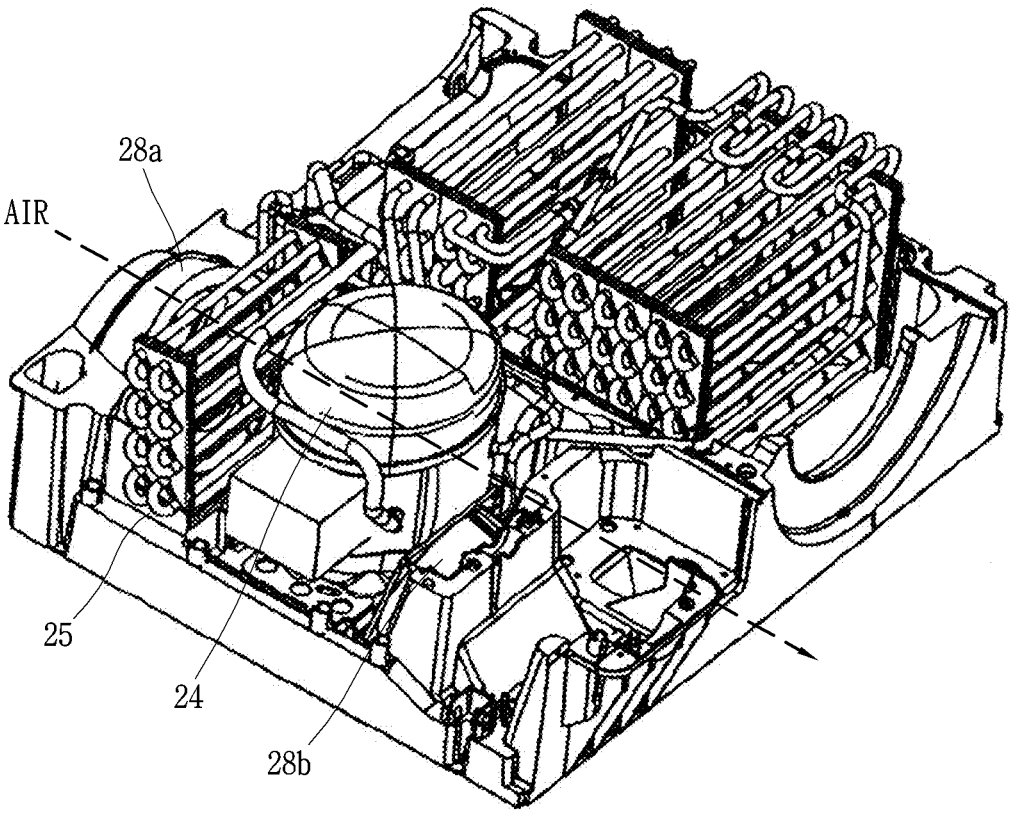
FIG. 3 is a perspective view illustrating a heat pump system mounted in the clothes dryer of FIG. 2.
Figure 4:
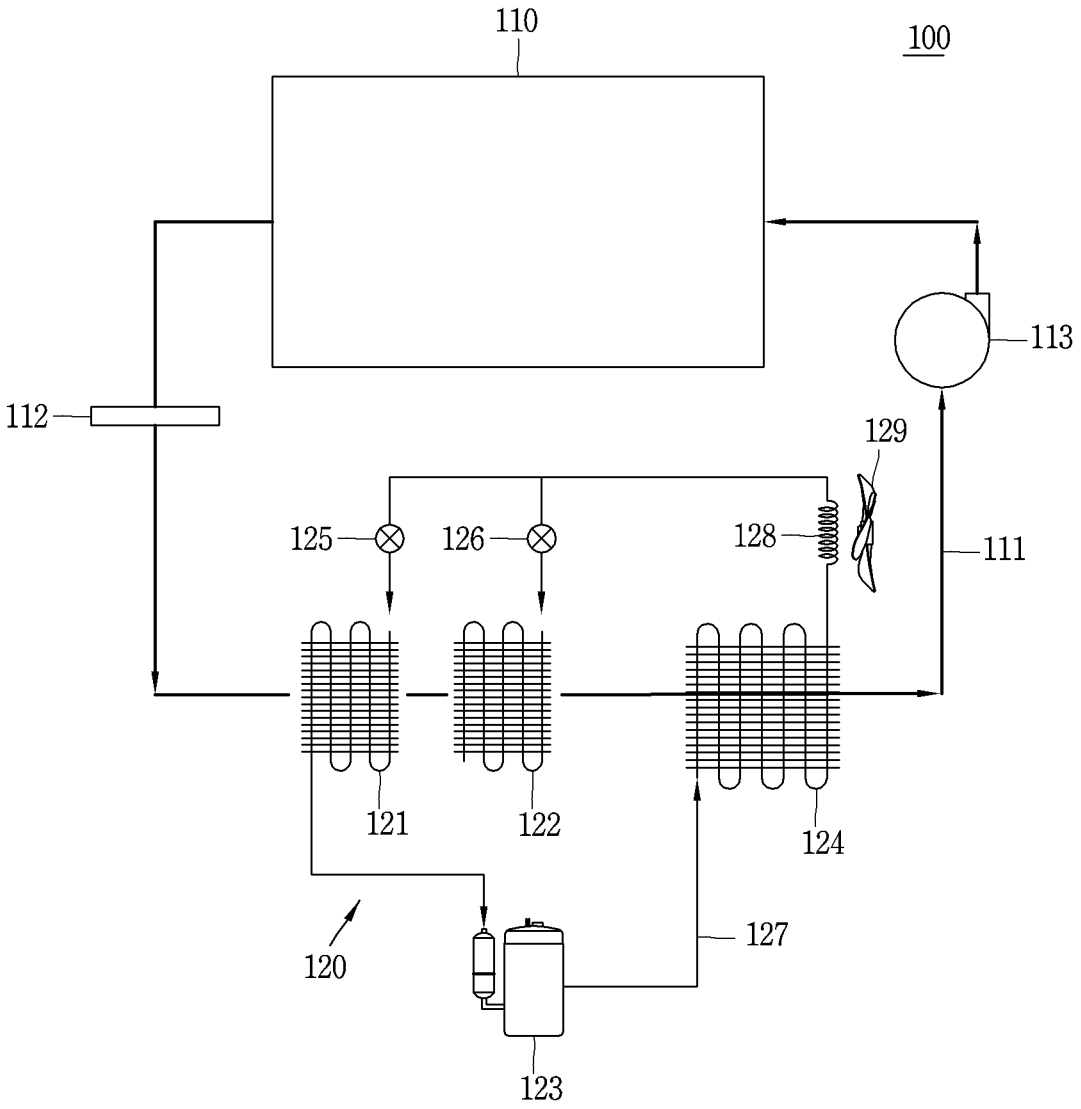
FIG. 4 is a perspective view illustrating a heat pump clothes dryer in accordance with one embodiment of the present invention.

FIG. 4 is a schematic view illustrating a heat pump clothes dryer 100 in accordance with one embodiment of the present invention.

The clothes dryer 100 according to the present invention includes, as basic components, a cabinet, a drum 110, a driving unit, a blower 113, a heat pump cycle 120, and the like. The clothes dryer 100 may dry clothes introduced in the drum 110 by heating air supplied into the drum 110 using the heat pump cycle 120.

The cabinet defines appearance of a product, and, for example, may have an overall shape similar to a rectangular parallelepiped.

The drum 110, which is a space for accommodating an object to be dried, is provided in the cabinet.

The drum 110 has a hollow cylindrical shape and provides an accommodating space in which clothes to be dried is introduced and dried. An opening is formed through a front surface of the drum 110, and an introduction opening is formed through a front surface of the cabinet. The opening and the introduction opening may communicate with each other such that the clothes can be introduced into the drum 110. A door for opening and closing the introduction opening may be coupled to the cabinet using a hinge structure.

In order to efficiently dry the clothes to be dried, the drum 110 may be rotatably installed, and a lifter may be provided inside the drum 110, so that the clothes can be tumbled by the lifter.

The driving unit may be implemented by a driving motor or the like. An output shaft of the driving motor and the drum 110 may be connected to each other by a power transmitting member such as a motor driving belt, so that a rotational force of the driving motor is transmitted to the drum 110 to rotate the drum 110.

The blower 113 is installed in an air flow path 111 along which air is introduced into the drum 110. The blower 113 applies power to the air such that the air passes through the drum 110, and circulates the air discharged from the drum 110 back into the drum 110.

The air flow path 111 is connected to the drum 110 to form a closed loop for the air circulation. For example, the air flow path 111 may be provided as an air duct. An outlet of the drum 110 for discharging air may be formed in a lower portion of the front end of the drum 110. An inlet of the drum 110 for an introduction of air may be formed in a rear surface of the drum 110. The air duct may communicate with the inlet and the outlet of the drum 110, to induce the air circulation.

A lint filter 112 may be installed in the outlet of the drum 110. Air discharged from the drum 110 may pass through the lint filter 112 so that lint contained in the air can be filtered and collected.

An object to be dried, namely, laundry or clothes (hereinafter, referred to as "clothes") accommodated within the drum 110 receives heat from supplied hot air such that moisture contained in the clothes is evaporated. Air contains such the evaporated moisture while passing through the drum 110 and then is discharged to the outlet of the drum 110. Hot and humid air discharged from the drum 110 is heated by receiving heat from the heat pump cycle 120 while moving along the air flow path 111, and then circulates back into the drum 110.

The heat pump cycle 120 includes evaporators 121 and 122, a compressor 123, a condenser 124, and expansion valves 125 and 126. The heat pump cycle 120 may use refrigerant as a working fluid. The refrigerant flows along a refrigerant pipe 127, and the refrigerant pipe 127 forms a closed loop for circulation of the refrigerant. The evaporators 121 and 122, the compressor 123, the condenser 124 and the expansion valves 125 and 126 are connected together by the refrigerant pipe 127 so that the refrigerant flows sequentially along the evaporators 121 and 122, the compressor 123, the condenser 124, and the expansion valves 125 and 126.

The evaporators 121 and 122 are heat exchangers which are installed in the air flow path 111 to communicate with the outlet of the drum 110 and causes heat exchange between the air discharged from the outlet of the drum 110 and the refrigerant, such that heat of the air discharged from the drum 110 can be collected without being discharged to the outside of the dryer.

The condenser 124 is a heat exchanger which is installed in the air flow path 111 to communicate with the inlet of the drum 110 and causes heat exchange between air discharged through the evaporators 121 and 122 and the refrigerant, such that heat of the refrigerant absorbed in the evaporators 121 and 122 can be supplied to air to be introduced into the drum 110.

The evaporators 121 and 122 and the condenser 124 may be installed inside the air duct. The evaporators 121 and 122 may be connected to the outlet of the drum 110, and the condenser 124 may be connected to the inlet of the drum 110.

The evaporators 121 and 122 and the condenser 124 may be fin & tube type heat exchangers. The fin & tube type is a type in which a plate-shaped fin is attached to a hollow tube. As refrigerant flows along the inside of the tube and air flows along an outer surface of the tube, the refrigerant and the air exchange heat with each other. The fins are used to expand a heat exchange area between the air and the refrigerant.

The hot and humid air discharged from the drum 110 is higher in temperature than the refrigerant of the evaporators 121 and 122 so that the heat of the air is taken by the refrigerant of the evaporators 121 and 122 while the air passes through the evaporators 121 and 122. This allows the air to be cooled and condensed. Accordingly, the hot and humid air may be dehumidified (moisture is removed from the air) by the evaporators 121 and 122, and condensed water may be collected into a sump provided below the evaporators 121 and 122 so as to be drained.

The air passed through the evaporators 121 and 122 flows into the condenser 124. The air is then heated by receiving heat radiated from the refrigerant of the condenser 124 while passing through the condenser 124, and then introduced into the drum 110.

In this manner, the heat pump cycle 120 may collect heat of air absorbed in the evaporators 121 and 122 and transfer the collected heat to the condenser 124. The heat pump cycle 120 may then supply the heat to the air again in the condenser 124 to heat the air, thereby supplying hot air into the drum.

A heat source of air absorbed in the evaporators 121 and 122 is transferred to the condenser 124 through the medium of the refrigerant. The compressor 123 is located between the evaporators 121 and 122 and the condenser 124 to transfer the heat source from the evaporators 121 and 122 (a low-temperature heat source portion) to the condenser 124 (a high-temperature heat source portion)

The compressor 123 compresses the refrigerant evaporated in the evaporators 121 and 122 into a state of high temperature and high pressure and then transfers the compressed refrigerant to the condenser 124, in order to provide power to the refrigerant. To this end, the compressor 123 is installed in the refrigerant pipe 127 extending from the evaporators 121 and 122 to the condenser 124. The compressor 123 may be an inverter type compressor 123 that can vary a frequency for controlling a discharge amount of the refrigerant.

The expansion valves 125 and 126 expand the refrigerant condensed in the condenser 124 to a state of low temperature and low pressure, and transfer the expanded refrigerant to the evaporators 121 and 122. To this end, the expansion valves 125 and 126 are installed in the refrigerant pipe 127 extending from the condenser 124 to the evaporators 121 and 122.

As such, the heat pump cycle 120 that carries a heat source from a low-temperature heat source portion to a high-temperature heat source portion repeatedly circulates the refrigerant in the following sequence.

Refrigerant flows into the evaporators 121 and 122, and is evaporated by receiving from the evaporators 121 and 122 a heat source of high temperature and high humidity air discharged from the drum 110. At this time, the heat source of the air is transferred to the refrigerant in a form of latent heat to change the refrigerant from a liquid phase to a vapor phase.

Subsequently, the refrigerant is discharged from the evaporators 121 and 122 and introduced into the compressor 123. As the refrigerant is compressed by the compressor 123, the refrigerant in the vapor phase is changed into a state of high temperature and high pressure.

Continuously, the refrigerant is discharged from the compressor 123 and introduced into the condenser 124. The refrigerant is then condensed as its heat is absorbed in the condenser 124. Accordingly, the vapor refrigerant of high temperature and high pressure is changed to the liquid phase. At this time, the heat of the refrigerant is transferred to the air in a form of latent heat.

Next, the refrigerant is discharged from the condenser 124, and introduced into the expansion valves 125 and 126. The refrigerant is then decompressed by a throttling action of the expansion valves 125 and 126 (or capillary tubes and the like), thereby being changed to the liquid refrigerant of low temperature and low pressure.

Finally, the refrigerant is discharged from the expansion valves 125 and 126 and introduced back into the evaporators 121 and 122, thereby forming one cycle. Such cycle is repeated.

In the present invention, the plurality of evaporators 121 and 122 are provided to improve dehumidifying capability.

The plurality of evaporators 121 and 122 may be installed in series in the air duct.

The plurality of evaporators 121 and 122 may be provided as first to nth evaporators.

Here, the nth evaporator may be any one of a second evaporator 122, a third evaporator, . . . , and the nth evaporator.

The first evaporator 121 to the nth evaporator may be arranged sequentially from an upstream side to a downstream side of the air duct on the basis of an air flow direction.

The first evaporator 121 illustrated in FIG. 4 may be connected to the outlet of the drum 110, and the second evaporator 122 may be connected to an outlet of the first evaporator 121.

The air discharged from the drum 110 may pass sequentially through the first evaporator 121 to the nth evaporator. At this time, temperature of the air is lower when passing through the second evaporator 122 than when passing through the first evaporator 121.

When a temperature difference between the air passing through the evaporators 121 and 122 and the refrigerant is greater, the dehumidifying capability is further improved.

For example, when the temperature of the air passing through the first evaporator 121 is 50° C. and the temperature of the refrigerant passing through the first evaporator 121 is 40° C., the temperature difference between the air and the refrigerant passing through the first evaporator 121 is 10° C. Also, when the temperature of the air passing through the second evaporator 122 is 45° C. and the temperature of the refrigerant passing through the second evaporator 122 is 40° C., the temperature difference between the air and the refrigerant passing through the second evaporator 122 is 5° C.

At this time, an amount of heat absorbed in the second evaporator 122 may be reduced by about a half of an amount of heat absorbed in the first evaporator 121.

In order to increase the amount of heat absorbed in the second evaporator 122, the temperature of the refrigerant passing through the second evaporator 122 may be lowered when the air and the refrigerant passing through the second evaporator 122 have the same temperature.

Accordingly, the temperature difference between the air and the refrigerant passing through the second evaporator 122 may be increased so as to increase the amount of heat absorbed in the second evaporator 122, thereby improving the dehumidifying capability of the evaporators.

The temperature of the refrigerant passing through the first to nth evaporators may be adjusted according to a flow rate of the refrigerant introduced into each evaporator.

The flow rate of the refrigerant introduced into each of the first to nth evaporators can be controlled by each of first to nth expansion valves.

The first to nth expansion valves may include a first expansion valve 125, a second expansion valve 126, . . . , and an nth expansion valve.

The first to nth expansion valves may be installed in first to nth branch pipes, respectively. The first to nth branch pipes may be a part of the refrigerant pipe 127 extending from the condenser 124 to the first to nth expansion valves.

The first to nth branch pipes are branched from the main refrigerant pipe to the respective expansion valves, and communicate with the respective evaporators.

The heat pump cycle 120 illustrated in FIG. 4 includes a first evaporator 121, a second evaporator 122, a compressor 123, a condenser 124, an auxiliary heat exchanger 128, a first expansion valve 125, and a second expansion valve 126.

In order to improve dehumidifying capability of the evaporators 121 and 122, a flow rate of the refrigerant introduced into the second evaporator 122 may be controlled to be smaller than a flow rate of the refrigerant introduced into the first evaporator 121.

For example, by making an open degree of the second expansion valve 126 narrower than that of the first expansion valve 125, the flow rate of the refrigerant flowing into the second evaporator 122 may be reduced.

The expansion valves 125 and 126 lower a refrigerant temperature as the open degree becomes narrower due to a throttling action.

Accordingly, the temperature of the refrigerant flowing into the second evaporator 122 becomes lower than the temperature of the refrigerant flowing into the first evaporator 121.

For example, when the temperature of the refrigerant flowing into the first evaporator 121 is 40° C. and the temperature of the refrigerant flowing into the second evaporator 122 is 35° C., even though THE temperature of the air passing through the first evaporator 121 is lowered from 50° C. to 45° C., the temperature difference of 10° C. is maintained between the air and the refrigerant in the first evaporator 121 as well as between the air and the refrigerant in the second evaporator 122, thereby maintaining dehumidifying capability.

The configuration in which the first and second evaporators 122 are disposed in series in the air duct is advantageous in view of designing the clothes dryer 100, in which a size of the air duct is limited in a height direction of the cabinet but is not limited in a back and forth direction of the cabinet.

The auxiliary heat exchanger 128 may be installed in the refrigerant pipe 127 extending from the condenser 124 to the expansion valve 124 on the basis of a flow direction of the refrigerant. The auxiliary heat exchanger 128 may be installed at a rear end of the condenser 124 or at a downstream side of the condenser 124 within the refrigerant pipe 127. The auxiliary heat exchanger 128 serves to cool the refrigerant discharged from the condenser 124.

The auxiliary heat exchanger 128 may be configured by a detachable condensing module, which is detachable from the condenser 124. The detachable condensing module may be configured in combination with the inverter type compressor 123.

The detachable condensing module illustrated in FIG. 4 may be provided with the auxiliary heat exchanger 128 and an auxiliary cooling fan 129. The auxiliary heat exchanger 128 and the auxiliary cooling fan 129 may be configured as one module or may be separated from each other.

The auxiliary cooling fan 129 transfers external air or internal air of the cabinet to the auxiliary heat exchanger 128 to cool the refrigerant discharged from the condenser 124.

Figure 5:
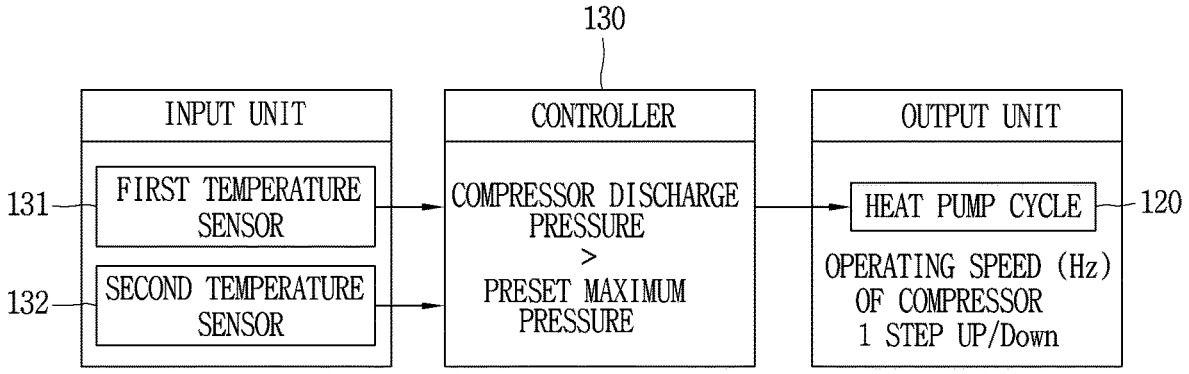
FIG. 5 is a block diagram illustrating a control flow for controlling a clothes dryer in accordance with the present invention.

FIG. 5 is a block diagram illustrating a control flow for controlling the clothes dryer 100 according to the present invention.

The clothes dryer 100 according to the present invention further includes a controller 130 for controlling the compressor 123 according to refrigerant discharge pressure of the compressor 123 or refrigerant inlet pressure of the condenser 124.

Accordingly, the controller 130 may adjust a refrigerant discharge amount by varying a frequency of the compressor 123 using the inverter compressor 123.

For example, an operating speed of the compressor 123 may be maximized at the early stage of drying. On the other hand, the operating speed of the compressor 123 may be controlled according to refrigerant discharge pressure of the compressor 123 after a time point of a constant rate interval.

A first temperature sensor 131 is provided in an outlet of the refrigerant pipe 127 of the compressor 123 to measure a refrigerant discharge temperature of the compressor 123. A second temperature sensor 132 is provided in a refrigerant inlet of the condenser 124 to measure a refrigerant inlet temperature of the condenser 124.

The controller 130 includes a memory for storing a preset temperature and the like, so as to compare the preset temperature with the measured temperatures, such as the refrigerant discharge temperature of the compressor and the refrigerant inlet temperature of the condenser 124 measured by the first temperature sensor 131 and the second temperature sensor 132.

Hereinafter, a method of controlling the clothes dryer 100 according to the present invention will be described.

Figure 6:
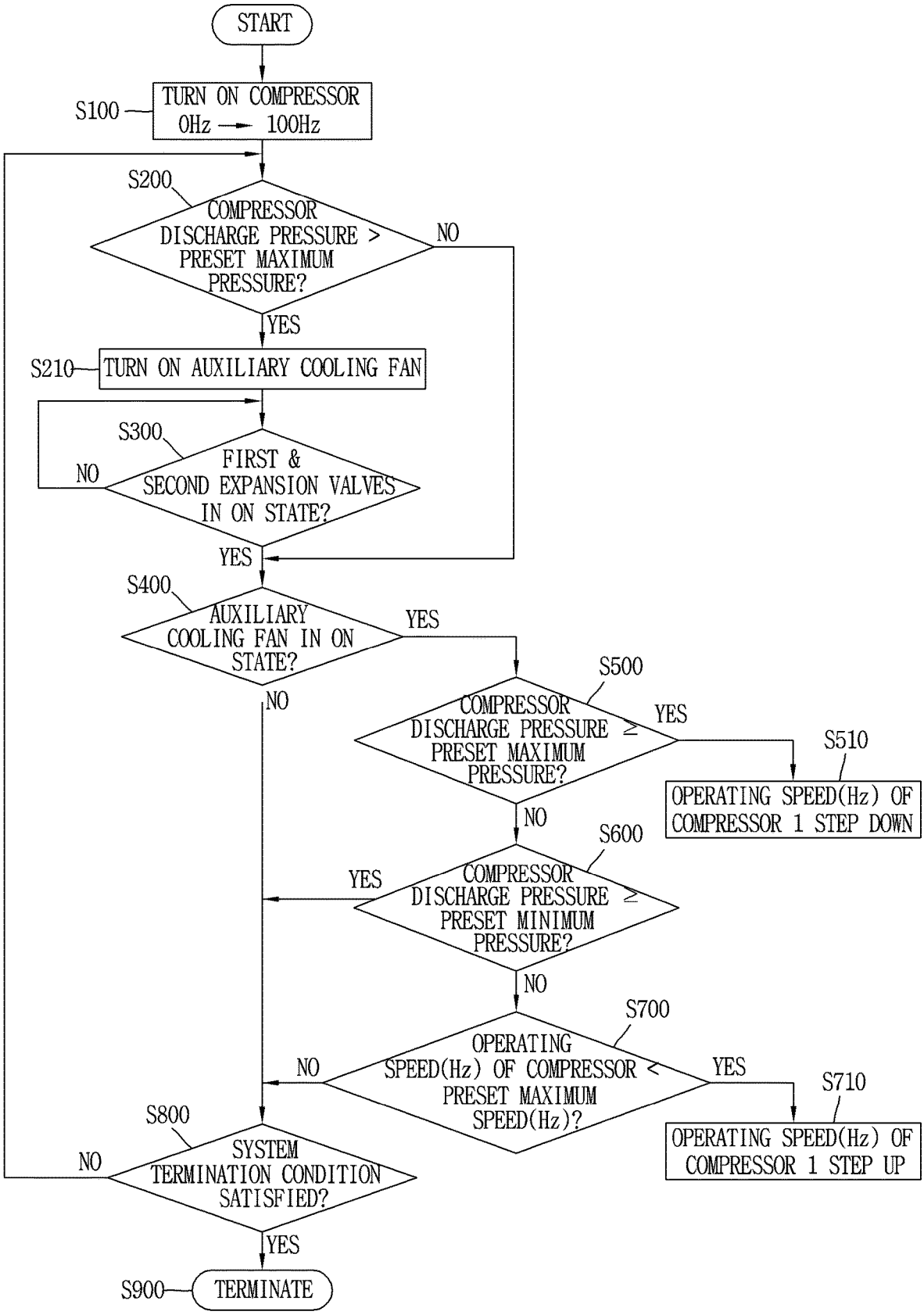
FIG. 6 is a flowchart illustrating a method of controlling a heat pump clothes dryer in accordance with one embodiment of the present invention.

FIG. 6 is a flowchart illustrating a method of controlling the heat pump clothes dryer 100 according to one embodiment of the present invention.

When a drying start signal is input through an input unit of the dryer, the inverter type compressor 123 is turned on and operated (S100). An operating speed (Hz) of the inverter type compressor 123 is increased. For example, the operating speed of the compressor 123 is raised from 0 Hz to 100 Hz.

After the heat pump system reaches a preset maximum operating speed of the compressor 123, an ON/OFF state of the auxiliary cooling fan 129 is determined depending on whether or not a condition of a function configured with parameters is satisfied. Here, the parameter is a variable by which the refrigerant discharge pressure of the compressor 123, the refrigerant discharge temperature of the compressor 123, the refrigerant inlet temperature of the condenser 124, the refrigerant inlet pressure of the condenser 124, or the like is input.

Subsequently, it is determined whether the refrigerant discharge pressure of the compressor 123 is greater than preset maximum pressure (S200).

When the refrigerant discharge pressure of the compressor 123 is greater than the maximum pressure, the auxiliary cooling fan 129 is turned on and blows cooling air to the auxiliary heat exchanger 128 so as to cool the refrigerant discharged from the condenser 124 (S210).

Next, temperature or humidity of the air discharged from the drum 110 is measured under the condition that the blower 113 is turned on. The first expansion valve 125 and the second expansion valve 126 are turned on according to the temperature or humidity of the air discharged from the drum 110, and open degrees of the first expansion valve 125 and the second expansion valve 126 are adjusted to a preset open degree. It is determined whether the first expansion valve 125 and the second expansion valve 126 are in the ON state (S300).

Next, it is determined whether or not the auxiliary cooling fan 129 is in the ON state when the first expansion valve 125 and the second expansion valve 126 are in the ON state (S400).

When the refrigerant discharge pressure of the compressor 123 is lower than or equal to the maximum pressure, it is determined whether the auxiliary cooling fan 129 is in the ON state (S400).

It is determined whether the refrigerant discharge pressure of the compressor 123 is greater than the preset maximum pressure when the auxiliary cooling fan 129 is in the ON state (S500).

When the auxiliary cooling fan 129 is in an OFF state, it is determined whether or not the drying termination condition is satisfied (S800).

Subsequently, the system is terminated when the drying termination condition is satisfied (S900).

On the other hand, when the refrigerant discharge pressure of the compressor 123 is greater than the preset maximum pressure, the operation speed (Hz) of the compressor 123 is lowered by one step (S510).

Also, when the refrigerant discharge pressure of the compressor 123 is equal to or lower than the preset maximum pressure, it is determined whether the refrigerant discharge pressure of the compressor 123 exceeds preset minimum pressure (S600).

It is determined whether or not the drying termination condition is satisfied when the refrigerant discharge pressure of the compressor 123 exceeds the preset minimum pressure, and the heat pump system is terminated when the drying termination condition is satisfied (S900).

Then, when the refrigerant discharge pressure of the compressor 123 is equal to or lower than the preset minimum pressure in S600, it is determined whether or not the operating speed of the compressor 123 is slower than a preset maximum speed (S700).

When the operation speed of the compressor 123 is slower than the preset maximum speed in S700, the operating speed of the compressor 123 is increased by one step and the operation of the system is started (S710).

When the operating speed of the compressor 123 matches the preset maximum speed in S700, the operation of the heat pump system is maintained in a current state.

The system is terminated when the drying termination condition is satisfied during the operation in S800 (S900).

In a heat pump clothes dryer according to another embodiment of the present invention, it is easy to determine a failure (breakdown) of the auxiliary cooling fan.

Figure 7:
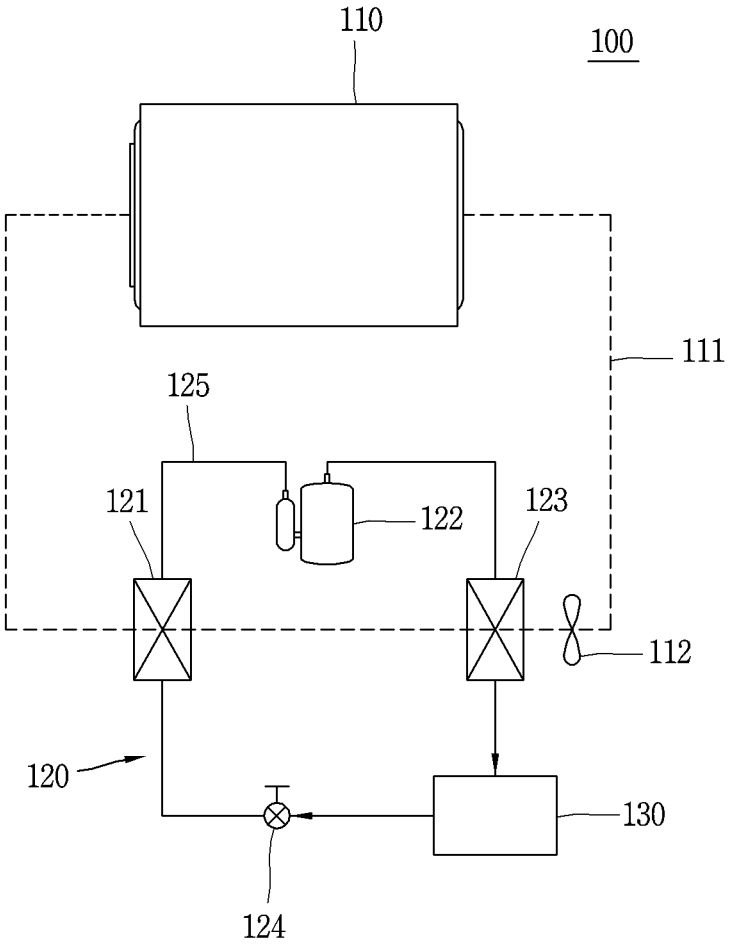
FIG. 7 is a perspective view illustrating a heat pump clothes dryer in accordance with one embodiment of the present invention.
Figure 8:
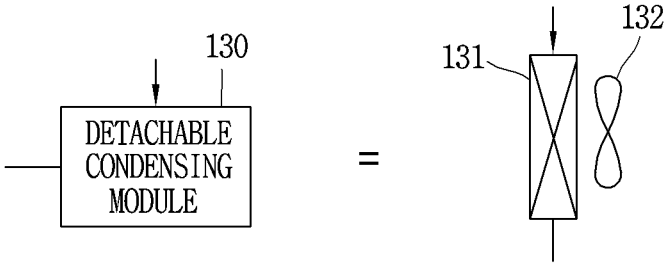
FIG. 8 is a schematic view illustrating a detachable (separate) condensing module.
Figure 9:
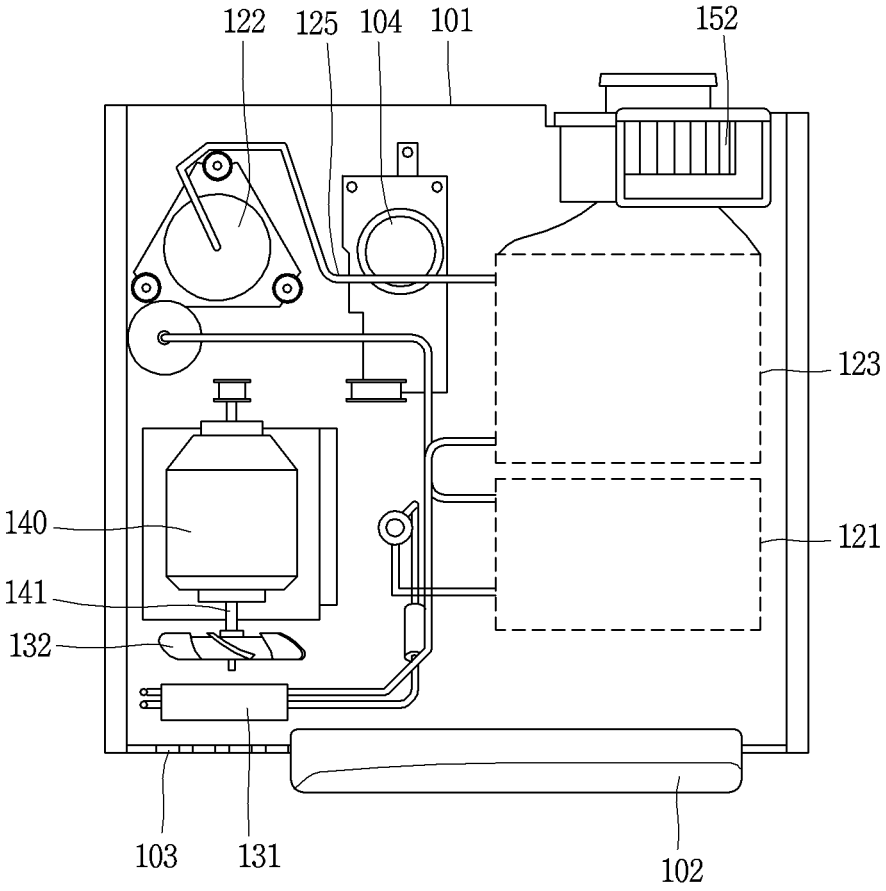
FIG. 9 is a planar view illustrating an example in which a heat pump system is applied to a base plate of a clothes dryer in accordance with one embodiment of the present invention.

FIG. 7 is a schematic view illustrating a heat pump clothes dryer 200 according to one embodiment of the present invention, FIG. 8 is a schematic view illustrating a detachable condensing module 230, FIG. 9 is a schematic view illustrating an example in which a heat pump system is applied to a base plate 201 of the clothes dryer 200 according to one embodiment of the present invention.

The clothes dryer 200 according to the present invention basically includes a cabinet, a drum 210, a driving unit, a blower 212 (a main cooling fan), a heat pump cycle 220, and the like. The clothes dryer 200 may heat air supplied into the drum 210 using the heat pump cycle 220, so as to dry clothes introduced in the drum 210.

The cabinet defines appearance of a product, and, for example, may have an overall shape similar to a rectangular parallelepiped.

The drum 210, which is a space for accommodating an object to be dried, is provided in the cabinet.

The drum 210 has a hollow cylindrical shape and provides an accommodating space in which clothes to be dried is introduced and dried. An opening is formed through a front surface of the drum 210, and an introduction opening is formed through a front surface of the cabinet. The opening and the introduction opening may communicate with each other such that the clothes can be introduced into the drum 210. A door 202 for opening and closing the introduction opening may be coupled to the cabinet by a hinge structure.

In order to efficiently dry the clothes to be dried, the drum 210 may be rotatably installed, and a lifter may be provided inside the drum 210, so that the clothes can be tumbled by the lifter.

The driving unit may be implemented as a driving motor 240 or the like. An output shaft 241 of the driving motor 240 and the drum 210 may be connected to each other by a power transferring member such as a motor driving belt 242 (see FIG. 10), such that a rotational force of the driving motor 240 is transferred to the drum 210 to rotate the drum 210.

The blower 212 is installed in an air flow path 211 along which air is introduced into the drum 210. The blower 113 applies power to the air such that the air passes through the drum 210, and circulates the air discharged from the drum 210 back into the drum 210.

The air flow path 211 is connected to the drum 210 to form a closed loop for the air circulation. For example, the air flow path 211 may be provided as an air duct. An outlet of the drum 210 for discharging air is formed in a front lower portion of the drum 210, and an inlet of the drum 210 for introducing air into the drum 210 is formed in a rear surface of the drum 210. The air duct may communicate with the outlet and the inlet of the drum to induce the air circulation.

A lint filter is installed in the outlet of the drum. The air discharged from the drum 210 may pass through the lint filter so that lint contained in the air can be collected.

An object to be dried, namely, laundry or clothes (hereinafter, referred to as "clothes") accommodated within the drum 210 receives heat from supplied hot air such that moisture contained in the clothes is evaporated. Air then contains such the evaporated moisture while passing through the drum 110 and then is discharged to the outlet of the drum 210. Hot and humid air discharged from the drum 210 is heated by receiving heat from the heat pump cycle 220 while moving along the air flow path 211, thereby circulating back into the drum 210.

The heat pump cycle 220 includes an evaporator 221, a compressor 222, a condenser 223, and an expansion valve 224. The heat pump cycle 220 may use refrigerant as a working fluid. The refrigerant flows along a refrigerant pipe 225, and the refrigerant pipe 225 forms a closed loop for circulation of the refrigerant. The evaporator 221, the compressor 222, the condenser 223 and the expansion valve 224 are connected by the refrigerant pipe 225 so that the refrigerant flows sequentially through the evaporator 221, the compressor 222, the condenser 223, and the expansion valve 224.

The evaporator 221 is a heat exchanger which is installed in the air flow path 211 to communicate with the outlet of the drum and causes heat exchange between the air discharged from the outlet of the drum and the refrigerant, such that heat of the air discharged from the drum can be collected without being discharged to the outside of the dryer 200.

The condenser 223 is a heat exchanger which is installed in the air flow path 211 to communicate with the inlet of the drum 210 and causes heat exchange between air passing through the evaporator 221 and the refrigerant, such that heat of the refrigerant which has been absorbed in the evaporator 221 can be supplied to air to be introduced into the drum 210.

The evaporator 221 and the condenser 223 may be installed inside the air duct. The evaporator 221 may be connected to the outlet of the drum, and the condenser 223 may be connected to the inlet of the drum 210.

The evaporator 221 and the condenser 223 may be fin & tube type heat exchangers. The fin & tube type is a type in which a plate-shaped fin is attached to a hollow tube. As refrigerant flows along the inside of the tube and air flows along an outer surface of the tube, the refrigerant and the air exchange heat with each other. The fins are used to expand a heat exchange area between the air and the refrigerant.

The hot and humid air discharged from the drum 210 is higher in temperature than the refrigerant of the evaporator 221 so that the heat of the air is taken by the refrigerant of the evaporator 221 while the air passes through the evaporator 221. This allows the air to be condensed and cooled.

Accordingly, the hot and humid air may be dehumidified (moisture is removed from the air) by the evaporator 221, and condensed water may be collected into a sump provided below the evaporator 221 so as to be drained.

The air passed through the evaporator 221 flows into the condenser 223. The air is then heated by receiving heat radiated from the refrigerant of the condenser 223 while passing through the condenser 223, and then introduced into the drum 210.

In this manner, the heat pump cycle 220 may collect heat of air absorbed in the evaporator 221 and transfer the collected heat to the condenser 223. The heat pump cycle 120 may then apply the heat to the air again in the condenser 223 to heat the air, thereby supplying hot air into the drum 210.

A heat source of air absorbed in the evaporator 221 is transferred to the condenser 223 through the medium of the refrigerant. The compressor 222 is located between the evaporator 221 and the condenser 223 to move the heat source from the evaporator 221 (a low-temperature heat source portion) to the condenser 223 (a high-temperature heat source portion).

The compressor 222 compresses the refrigerant, which has been evaporated in the evaporator 221, into a state of high temperature and high pressure and then transfer the compressed refrigerant to the condenser 223, in order to provide power to the refrigerant. To this end, the compressor 222 is installed in the refrigerant pipe 225 extending from the evaporator 221 to the condenser 223. The compressor 222 may be an inverter type compressor 222 that can vary a frequency for controlling a discharge amount of the refrigerant.

The expansion valve 224 expands the refrigerant condensed in the condenser 223 to a state of low temperature and low pressure, and transfers the expanded refrigerant to the evaporator 221. To this end, the expansion valve 224 is installed in the refrigerant pipe 225 extending from the condenser 223 to the evaporator 221.

As such, the heat pump cycle 220 that carries a heat source from a low-temperature heat source portion to a high-temperature heat source portion repeatedly circulates the refrigerant in the following sequence.

Refrigerant flows into the evaporator 221, and is evaporated by receiving from the evaporator 221 a heat source of high temperature and high humidity air discharged from the drum 110. At this time, the heat source of the air is transferred to the refrigerant in a form of latent heat to change the refrigerant from a liquid phase to a vapor phase.

Subsequently, the refrigerant is discharged from the evaporator 221 and introduced into the compressor 222. As the refrigerant is compressed by the compressor 222, the vapor (gaseous) refrigerant is changed into a state of high temperature and high pressure.

The refrigerant is then discharged from the compressor 222 and introduced into the condenser 223. The refrigerant is then condensed as its heat is absorbed in the condenser 223. Accordingly, the vapor refrigerant of high temperature and high pressure is changed to the liquid phase. At this time, the heat of the refrigerant is transferred to the air in a form of latent heat.

Next, the refrigerant is discharged from the condenser 223, and introduced into the expansion valve 224. The refrigerant is then decompressed by a throttling action of the expansion valve 224 (or a capillary tube and the like), thereby being changed to the liquid refrigerant of low temperature and low pressure.

Finally, the refrigerant is discharged from the expansion valve 224 and introduced back into the evaporator 221, thereby forming one cycle. Such cycle is repeated.

Here, the heat pump cycle 220 according to the present invention further includes an auxiliary heat exchanger 231.

The auxiliary heat exchanger 231 may be installed in the refrigerant pipe 225 extending from the condenser 223 to the expansion valve 224 on the basis of a flow direction of the refrigerant. The auxiliary heat exchanger 231 may be installed at a rear end of the condenser 223 or at a downstream side of the condenser 223 within the refrigerant pipe 225. The auxiliary heat exchanger 231 serves to cool the refrigerant discharged from the condenser 223.

The auxiliary heat exchanger 231 may be configured by a detachable condensing module 230 separated from the condenser 223. The detachable condensing module 230 may be configured in combination with the inverter type compressor 222.

The detachable condensing module 230 illustrated in FIG. 8 may include the auxiliary heat exchanger 231 and an auxiliary cooling fan 232. The auxiliary heat exchanger 231 and the auxiliary cooling fan 232 may be configured as one module or may be separated from each other.

The auxiliary cooling fan 232 is a component that cools the auxiliary heat exchanger 231 by blowing external air or internal air of the cabinet to the auxiliary heat exchanger 231. However, since the auxiliary cooling fan 232 according to the present invention uses power of the driving motor 240 for driving the drum 210, it is not necessary to employ a separate fan-dedicated motor for the auxiliary cooling fan 232.

For example, the auxiliary cooling fan 232 may be provided with a rotating shaft and a blade. The rotating shaft may be directly or indirectly connected to the driving motor 240 for driving the drum 210.

That is, the auxiliary cooling fan 232 may be divided into a direct driving type that the auxiliary cooling fan 232 is directly driven, and an indirect driving type that the auxiliary cooling fan 232 is indirectly driven, according to a connection method with the driving motor 240 of the drum 210.

The auxiliary cooling fan 232 illustrated in FIG. 9 illustrates a connection structure with the driving motor 240 of the drum 210 according to the direct driving method.

An output shaft 241 of the driving motor 240 for driving the drum 210 is directly connected to the rotating shaft of the auxiliary cooling fan 232, so that power of the driving motor 240 can be transmitted to the auxiliary cooling fan 232.

The blade may be in plurality. The plurality of blades may be connected to each other by a hub 332*b* connected to the rotating shaft 332*a* illustrated in FIG. 10. The hub 332*b* is coupled to the rotating shaft 332*a* to transmit power of the rotating shaft 332*a* to the blades so as to simultaneously rotate the blades (see FIG. 10).

Accordingly, the auxiliary cooling fan 232 uses the power of the driving motor 240 for driving the drum 210, and thus does not need a separate cooling fan-dedicated motor.

In addition, a separate driving element for driving the auxiliary cooling fan 232 can be removed, thereby simplifying the structure.

Since the auxiliary cooling fan 232 and the drum 210 share the power of the single driving motor 240, additional power for driving the auxiliary cooling fan 232 is not required.

Further, continuous performance of the auxiliary cooling fan 232 can be ensured under a condition that the driving motor 240 of the drum 210 is not broken down.

When the motor driving belt 242 connecting the driving motor 240 and the drum 210 is cut or the drum 210 is not rotated, since a system for determining whether or not the drum 210 or the like is broken down is employed in the existing products, it may also be possible to determine whether the auxiliary cooling fan connected to the drum 210 is out of order, without an addition of a separate component.

Further, the auxiliary cooling fan 232 according to the present invention does not have to be controlled to be turned on/off. That is, since it is not necessary to check a detected temperature signal and turn on/off the motor according to the temperature signal, the auxiliary cooling fan 232 does not have to be separately controlled.

FIG. 9 illustrates the clothes dryer 200 in which components disposed on a lower portion of the drum 210 are exposed after the drum 210 is removed.

In FIG. 9, a front plate of the cabinet is disposed on a bottom of the drawing, and a door 202 is provided on the front plate. A rear plate (not illustrated) of the cabinet is arranged on a top of the drawing, and the blower 252 is provided on the rear plate. The blower 252 has a separate fan motor and thus can be driven, independent of the drum 210.

An air duct (not shown) extending from the front door 202 toward the rear blower 252 is provided on an inner surface of a right side of the cabinet, and a front portion of the air duct is connected to the outlet of the drum 210, to form a circulation flow path for the air discharged from the drum 210. The evaporator 221 and the condenser 223 are installed in the air duct so that the air discharged from the drum 210 passes sequentially through the evaporator 221 and the condenser 223.

A blower 212 is connected to a rear portion of the air duct to suck air discharged from the condenser 223 and supply the sucked air back to the drum 210.

Side plates are disposed at left and right sides of FIG. 9, the auxiliary heat exchanger 231, the auxiliary cooling fan 232, the driving motor 240, and the compressor 222 are disposed on an inner side surface of the left side plate sequentially from front (bottom) to rear sides.

A plurality of slits 203 are formed through the front plate of the cabinet so that external air and internal air of the cabinet communicate with each other. As the auxiliary cooling fan 232 is operated, the external air of the cabinet flows into the cabinet through the slits 203 and passes through the auxiliary heat exchanger 231 to cool the refrigerant of the auxiliary heat exchanger 231.

The air passing through the auxiliary heat exchanger 231 may cool the driving motor 240.

In addition, the air may cool the compressor 222 located behind the driving motor 240.

The auxiliary heat exchanger 231 is disposed between the condenser 223 and the expansion valve 224 and is connected to the condenser 223 by the refrigerant pipe 225 to cool the refrigerant discharged from the condenser 223.

The expansion valve 224 is disposed between the auxiliary heat exchanger 231 and the evaporator 221 and is connected to the evaporator 221 by the refrigerant pipe 225 to decompress the refrigerant cooled in the auxiliary heat exchanger 231 and then transfer the decompressed refrigerant to the evaporator 221.

The compressor 222 is disposed between the evaporator 221 and the condenser 223 and is connected to the condenser 223 by the refrigerant pipe 225 to compress the refrigerant evaporated in the evaporator 221.

A sump 204 is provided in the middle between the compressor 222 and the blower 252 to collect washing water discharged from the drum 210 and drain it to the outside of the cabinet.

Figure 10:
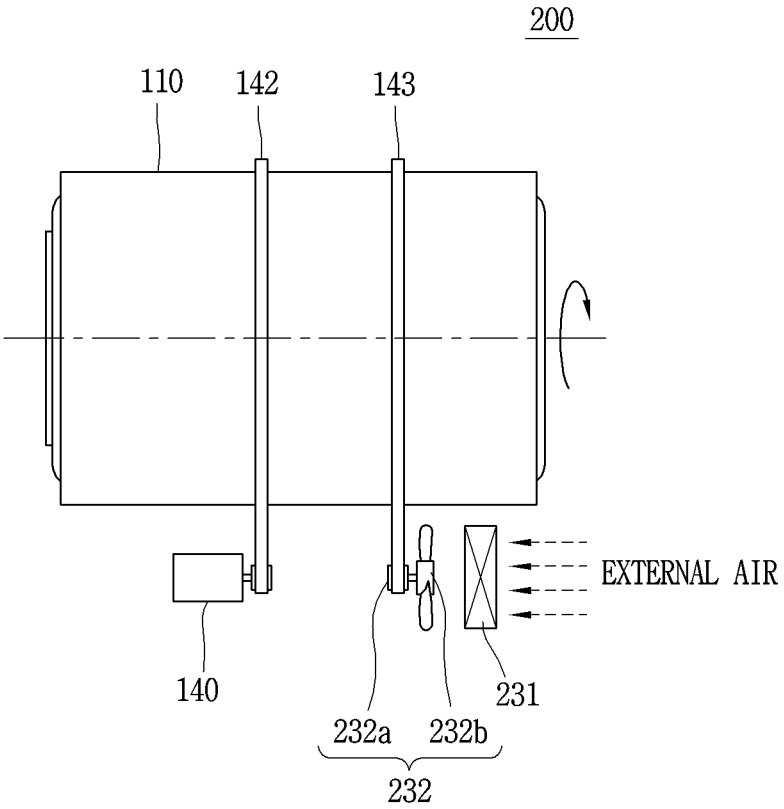
FIG. 10 is a schematic view illustrating an indirect operating (driving) method of an auxiliary cooling fan in accordance with the present invention.

FIG. 10 is a schematic view illustrating an indirect driving method of the auxiliary cooling fan 332 according to another embodiment of the present invention.

The auxiliary cooling fan 332 illustrated in FIG. 10 receives power from the drum 210.

To this end, at least one fan belt 243 for transmitting power from the drum 210 to the auxiliary cooling fan 332 may be provided. For example, as the fan belt 243 is further wound on an outer circumferential surface of the drum 210 and connected to the rotating shaft 332*a* of the auxiliary cooling fan 332, a rotational force of the drum 210 may be used as power for the auxiliary cooling fan 332.

The auxiliary cooling fan 332 may be further provided with a planetary gear system including a sun gear, a planetary gear and a ring gear, so as to increase an RPM of the auxiliary cooling fan 332 as compared with the RPM of the drum 210.

An acceleration element for increasing the RPM of the auxiliary cooling fan 332 is not limited to the planetary gear system but may be configured in various embodiments.

The clothes dryer 100, 200, 300 described above is not limited to the configurations and the methods of the embodiments described above, but the embodiments may be configured by selectively combining all or part of the embodiments so that various modifications or changes can be made.

The invention claimed is:

1. A method for controlling a dryer, supplying hot air into a drum using a heat pump cycle provided with a first evaporator, at least one second evaporator, a compressor, a condenser, an auxiliary heat exchanger, a first expansion valve, and at least one second expansion valve, the method comprising:

turning on the compressor to operate the heat pump cycle;

adjusting a first flow rate of a refrigerant introduced into the first evaporator by adjusting the first expansion valve according to a temperature or a humidity of the air discharged from the drum;

adjusting a second flow rate of the refrigerant introduced into the at least one second evaporator by adjusting the at least one second expansion valve according to the temperature or the humidity of the air discharged from the drum; and controlling an operating speed of the compressor according to a refrigerant discharge pressure of the compressor or a refrigerant inlet pressure of the condenser.

2. The method of claim 1, further comprising:

measuring a refrigerant discharge temperature of the compressor or a refrigerant inlet temperature of the condenser before adjusting the first flow rate and the second flow rate after operating the compressor; and cooling the refrigerant discharged from the condenser by operating an auxiliary cooling fan when the refrigerant discharge temperature of the compressor or the refrigerant inlet temperature of the condenser exceeds a preset temperature.

3. The method of claim 2, wherein the first flow rate of the refrigerant is adjusted to be smaller than the second flow rate, so as to increase a temperature difference between the refrigerant and the air passing through the at least one second evaporator.

4. The method of claim 1, wherein the operating speed of the compressor is lowered when the refrigerant discharge pressure of the compressor or the refrigerant inlet pressure of the condenser is higher than a preset maximum pressure, and the operating speed of the compressor is increased when the refrigerant discharge pressure of the compressor or the refrigerant inlet pressure of the condenser is equal to or lower than a preset minimum pressure.

5. The method of claim 4, further comprising:

comparing the operating speed of the compressor with a preset maximum speed before increasing the operating speed of the compressor when the refrigerant discharge pressure of the compressor or the refrigerant inlet pressure of the condenser is equal to or lower than the preset minimum pressure;

increasing the operating speed of the compressor when the operating speed of the compressor is lower than the preset maximum speed; and maintaining the operating speed of the compressor when the operating speed of the compressor is a maximum speed.

* * * * *